United States Patent [19]

Demetriadis

[11] 4,155,142

[45] May 22, 1979

[54] TILE GROUT SCRAPER TOOL

[76] Inventor: Chrys C. Demetriadis, 25-45 80th St., Jackson Heights, N.Y. 11370

[21] Appl. No.: 619,407

[22] Filed: Oct. 3, 1975

[51] Int. Cl.[2] ..... A47L 13/02; E04F 21/17

[52] U.S. Cl. ..... 15/236 C; 15/235.3

[58] Field of Search ..... 15/105.5, 235.3, 235.6, 15/236 B, 236 C; 30/164.95, 172, 292, 307, 365, 347

[56] References Cited

U.S. PATENT DOCUMENTS

| | | | |
|---|---|---|---|
| 138,911 | 5/1873 | Merriken | 15/105.5 |
| D. 154,835 | 8/1949 | Bishop | 30/307 X |
| D. 235,704 | 7/1975 | Tyroler | 30/365 X |
| 552,267 | 12/1895 | Westphaln | 30/292 X |
| 1,681,667 | 8/1928 | Johnston et al. | 30/365 X |
| 2,947,084 | 8/1960 | Billings | 33/41 F X |
| 3,617,082 | 11/1971 | Sparks | 30/307 X |
| 3,924,328 | 12/1975 | Mould | 30/365 X |

*Primary Examiner*—Daniel Blum

[57] ABSTRACT

A traction tool for scraping away excessive grout between the joints of adjacent tile pieces of a floor or wall. The tool is fitted with a handle fixed to a base with a plurality of toothed wheels rotatably fitted in the base to extend below the undersurface of the base, the plane of all wheels lying on a common plane perpendicular to the undersurface of the base. The tool could be used to remove old grout prior to making a freshly grouted joint.

2 Claims, 4 Drawing Figures

TILE GROUT SCRAPER TOOL

SUMMARY OF THE INVENTION

My invention is a tool for scraping away excessive or old grout between the joints of adjacent tile pieces of a floor or wall. The tool is fitted with a handle fixed to a base with a plurality of toothed wheels rotatably fitted in the base to extend below the undersurface of the base, the plane of all wheels lying on a common plane perpendicular to the undersurface of the base.

In use, the tool is slid along a joint line of two tiles, with the wheels digging out excessive grout from the joint line as the tool is moved along the joint line.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
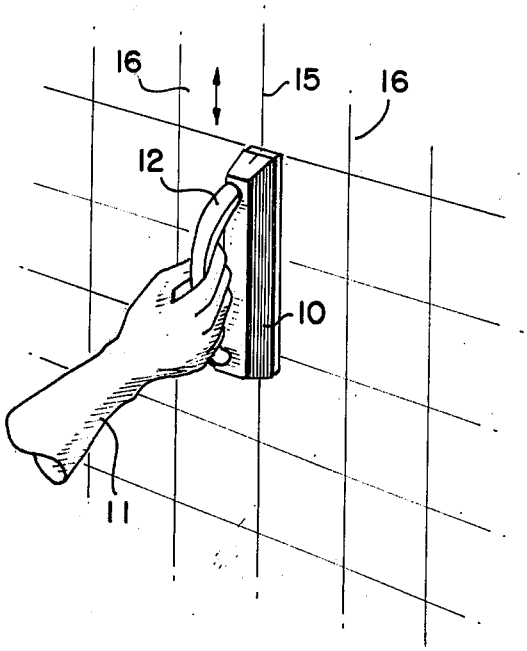
FIG. 1 is a perspective view of the invention in use.
Figure 2:
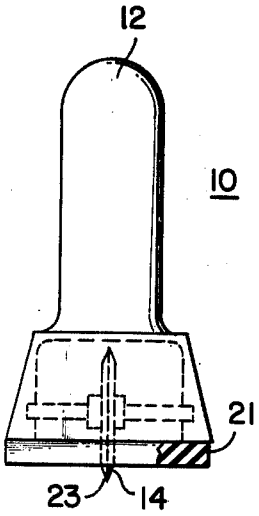
FIG. 2 is an end view of the invention.
Figure 3:
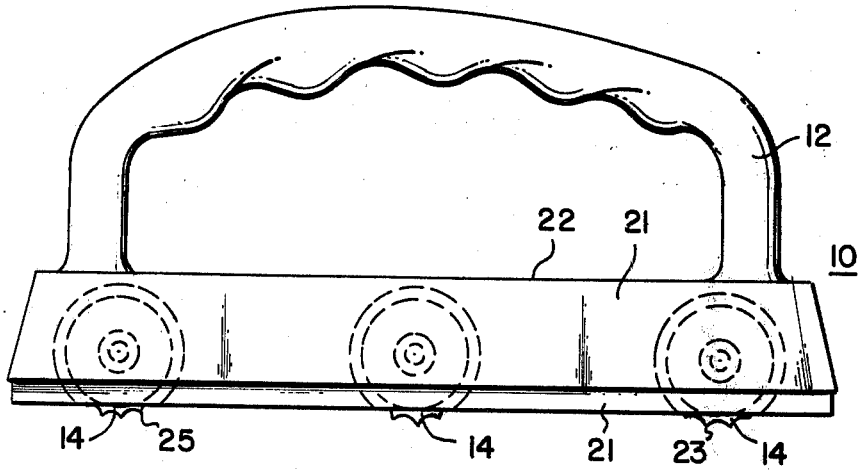
FIG. 3 is a side view of the invention.
Figure 4:
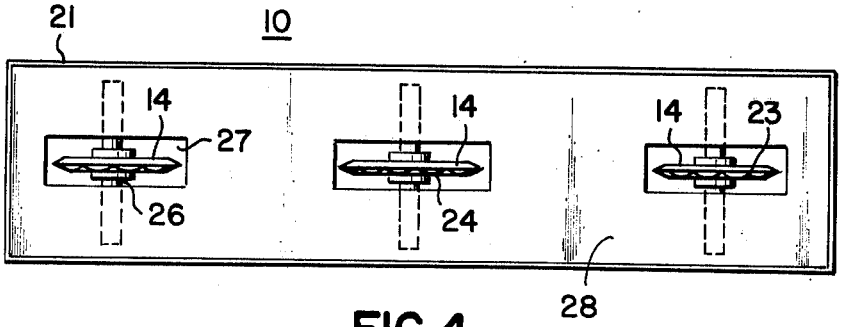
FIG. 4 is a bottom plan view of the invention.

Turning now descriptively to the drawings, in which similar reference characters denote similar elements throughout the several views, FIG. 1 illustrates a user 11 gripping the handle 12 of the tool 10 to roll the toothed wheels 14 along the line 15 of joint between adjacent tiles 16 on a wall for the purpose of removing excessive hardened grout in the joint preliminary to making a freshly grouted joint.

The tool base 21 is joined on its top surface 22 to handle 12 and is fitted with three rotatable wheels 14 that are each formed with a sharpened cutting edge 23 which are scalloped with concave recesses so as to form a series of pointed teeth 25 along the periphery of each wheel 14. The wheels 14 are set in the base on parallel rotatable axles 26 each mounted in a recess 27 open to the bottom surface 28 of the base 21 with each wheel circumference projecting about one-eighth of an inch beyond the base surface 28 and with each wheel periphery oriented in a common plane so as to roll in a common joint line between tiles.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tool for removing grout from a joint between tiles laid upon a common surface, comprising a base having a substantially planar underside fitted on a top side with a projecting handle, and fitted on the opposed underside with the projecting circumference of a single line of more than two wheels, with all of said wheels individually aligned along a common plane substantially perpendicular to the underside, and with each wheel rotatably mounted in a recess in the said base, with each said wheel formed on its periphery with a continuous scalloped cutting edge to form concave recesses each separated by pointed teeth, each said wheel projecting approximately one-eighth of an inch beyond the underside so that they can roll in a common joint line between tiles.

2. The combination as recited in claim 1 in which three said wheels are mounted to the base.

* * * * *